US005839483A

United States Patent [19]

Rejret et al.

[11] Patent Number: 5,839,483

[45] Date of Patent: Nov. 24, 1998

[54] BEVERAGE DISPENSER WITH SERVING TIME MONITOR

[75] Inventors: Richard Lee Rejret, Watertown; Jeffrey Hale, Hartland; Larry D. Powers, Watertown, all of Wis.

[73] Assignee: Eaton Corporation, Cleveland, Ohio

[21] Appl. No.: 812,460

[22] Filed: Mar. 6, 1997

[51] Int. Cl.[6] ..... B65B 1/04; B65B 3/04

[52] U.S. Cl. ..... 141/1; 141/94; 222/641; 222/71

[58] Field of Search ..... 141/1, 94, 95, 141/198, 192; 222/639–641, 129.1, 71; 364/479.06

[56] References Cited

U.S. PATENT DOCUMENTS

| | | | |
|---|---|---|---|
| 3,812,890 | 5/1974 | Haas et al. | 141/94 |
| 4,202,387 | 5/1980 | Upton | 141/94 |
| 4,572,405 | 2/1986 | Miura | 222/14 |
| 4,905,743 | 3/1990 | Gray | 141/198 |
| 5,027,284 | 6/1991 | Senghaas et al. | 222/71 |
| 5,040,106 | 8/1991 | Maag | 364/167 |
| 5,431,302 | 7/1995 | Tulley et al. | 222/14 |
| 5,454,406 | 10/1995 | Rejret et al. | 141/1 |
| 5,566,732 | 10/1996 | Nelson | 141/94 |

*Primary Examiner*—Steven O. Douglas
*Attorney, Agent, or Firm*—Quarles & Brady

[57] ABSTRACT

A switch, mounted on a standard beverage tap, provides an electrical signal indicating when beverage is being dispensed into a serving container. The electrical signal is applied to a monitor which measures the period of time that the beverage flows from the tap. As beverage dispensing occurs, a series of steps are taken which determine from the time measurements whether the dispensing is proceeding into one container, is complete, is part of a continuous pour into several containers or has been completed with a subsequent single container pouring operation occurring. That determination is based on whether the period of time is within a range indicative of dispensing the beverage into a single serving container. When that determination is made a serving container count is incremented. The monitor also uses the measured time period to detect when the tap is opened for longer than the typical time required to fill a single beverage container. In response to that detection, a numerical estimate is made of how many serving containers were filled while the beverage tap was open and the numerical estimate is added to the serving container count. The measured time that the tap was open also is employed to calculate the quantity of beverage that has been dispensed.

17 Claims, 6 Drawing Sheets

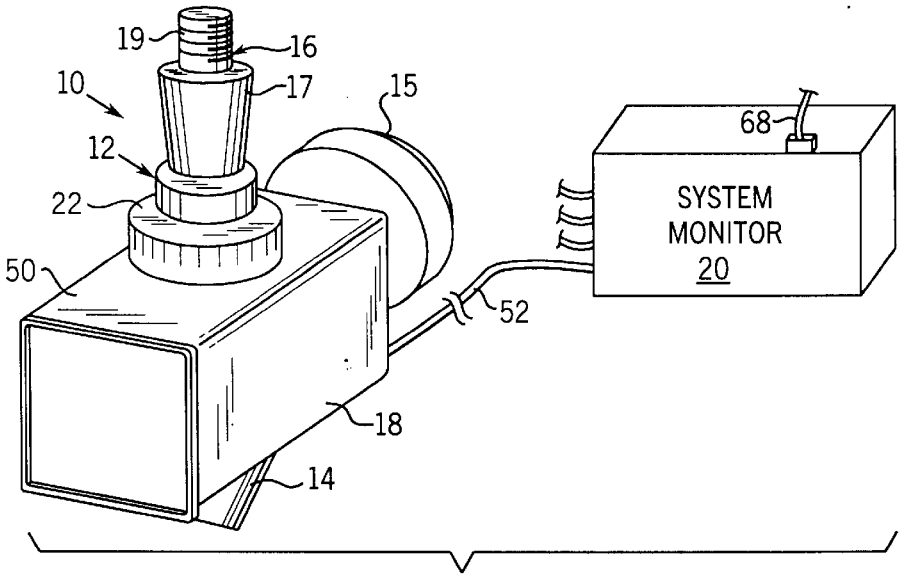
FIG. 1
FIG. 2
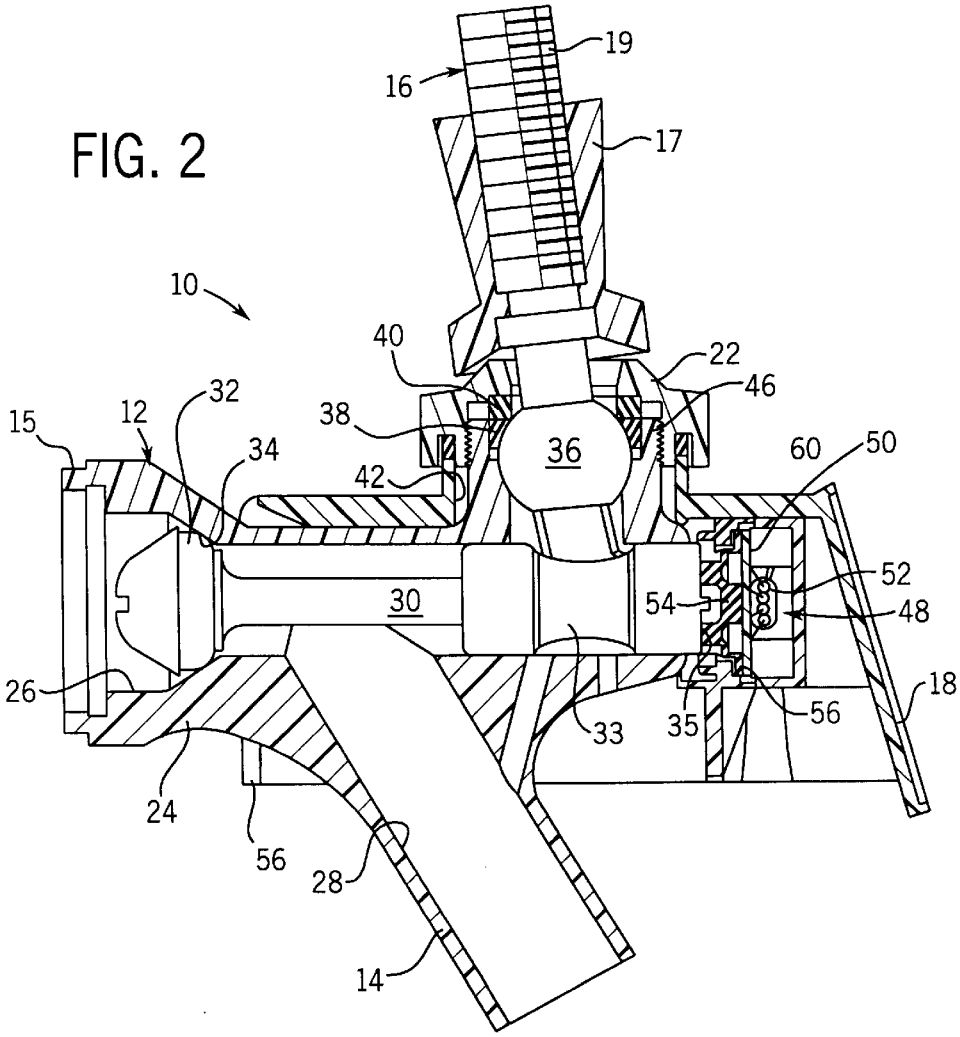

FIG. 3

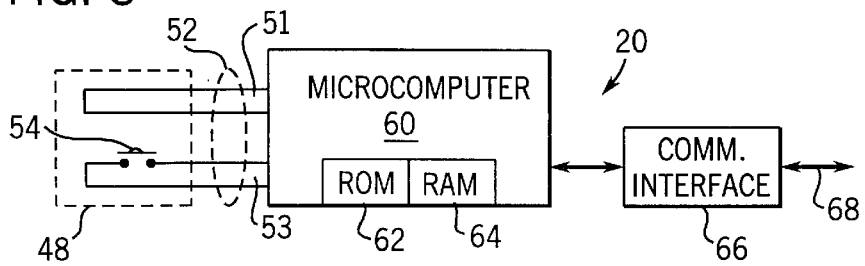

FIG. 4

| | | |
|---|---|---|
| 70 | DATA TABLE | |
| 72 | BEVERAGE CONTAINER VOLUME | |
| | LOW PERCENT | |
| | HIGH PERCENT | |
| | OFF IDLE TIME | |
| TAP 12 74 | TYPICAL POUR TIME (TYP) | |
| | MINIMUM POUR TIME (MIN) | |
| | MAXIMUM POUR TIME (MAX) | |
| | FLOW RATE | |
| | TM TIME | |
| | TOTAL TIME | |
| | OFF TIME | |
| | CALC FLAG | POUR FLAG |
| | SHORT POUR COUNT | |
| | SHORT POUR VOLUME | |
| | VALID POUR COUNT | |
| | VALID POUR VOLUME | |
| | OVER POUR COUNT | |
| | OVER POUR VOLUME | |
| | CONTINUOUS POUR COUNT | |
| | CONTINUOUS POUR VOLUME | |
| | OVER /CONTINUOUS POUR COUNT | |
| | OVER /CONTINUOUS POUR VOLUME | |
| 76 | SECOND TAP | |
| | | |
| 78 | Nth TAP | |

BEVERAGE DISPENSER WITH SERVING TIME MONITOR

BACKGROUND OF THE INVENTION

The present invention relates to manually operated beverage taps used to dispense beer and carbonated beverages; and more particularly to mechanisms for sensing when the tap is being operated by a beverage server and monitoring the amount of beverage that has been dispensed.

Beverage taps have a metal spout which receives a beverage, such as beer or carbonated soda, from a supply. The tap has an internal valve controlled by a lever that is operated by the beverage server when beverage dispensing is desired. When the valve is in an open position, the beverage flows under pressure from the supply through the tap and out of the spout into a serving container.

In many establishments which serve beverages, it is desirable to track the quantity of beverage that is dispensed in order to monitor product slippage. For example, the quantity of beverage served at a sports venue is monitored by counting the number of disposable containers that are filled. Although servers are prohibited from refilling containers for customers, a server may do so without collecting money or by pocketing the money paid by the customer. This beverage theft may go undetected, since a previously counted container was used.

Dispensing systems, such as the one described in U.S. Pat. No. 5,454,406, have been devised where a non-standard tap is controlled by a push button switch connected to a computer that operates the tap electrically when the server presses the switch. Because the beverage is dispensed from the tap at a constant rate, the computer is able to determine the quantity of beverage that is being dispensed by timing the period that the beverage flows from the spout. Thus, a determination can be made whether a significantly greater quantity of beverage has been dispensed than would be indicated by the container count. However, this system requires replacement of all the taps with ones that can be controlled by the computer; a relatively expensive procedure.

SUMMARY OF THE INVENTION

A general object of the present invention is to provide a mechanism that can be retrofitted onto an existing manually operated tap to monitor the beverage dispensing.

Another object is to monitor the tap operation by an electrical signal that simply indicates whether the tap is open or closed.

A further object of the present invention is to determine from such a simple electrical signal how many serving containers are filled at the tap.

Yet another object is to determine from that electrical signal the quantity of beverage that has been dispensed from the tap.

These and other objectives are satisfied by attaching a switch to a manually operated beverage tap to produce an electrical signal indicating whether the tap is open and closed. The electrical signal is processed to measure how long the beverage tap is open to produce a tap open time measurement. From that measurement determinations are made regarding the nature of the beverage dispensing operations performed by serving personnel.

The tap open time measurement is employed to determine when a serving container is filled with beverage and a count of such filled serving containers is maintained. The preferred method also is able to determine when the tap is left open continuously to fill a plurality of serving containers, the number of serving containers that are filled. The number is added to the count of serving containers. Another aspect of the preferred method is the ability to use the tap open time measurements in deriving the quantity of beverage dispensed from the beverage tap.

Thus from a relatively simple sensor, a switch which operates when the tap is opened and closed, the present novel method is able to determine how many beverage containers are being filled and the quantity of beverage that has been dispensed.

BRIEF DESCRIPTION OF THE DRAWINGS

FIG. 1 is an isometric view of a beverage tap that has been retrofitted with a monitoring system according to the present invention;

FIG. 2 is a cross sectional view through the beverage tap in a closed state;

FIG. 3 is block schematic diagram of the system monitor shown in FIG. 1;

FIG. 4 depicts the organization of data tables stored in the memory of the system monitor;

DETAILED DESCRIPTION OF THE INVENTION

Figure 5:
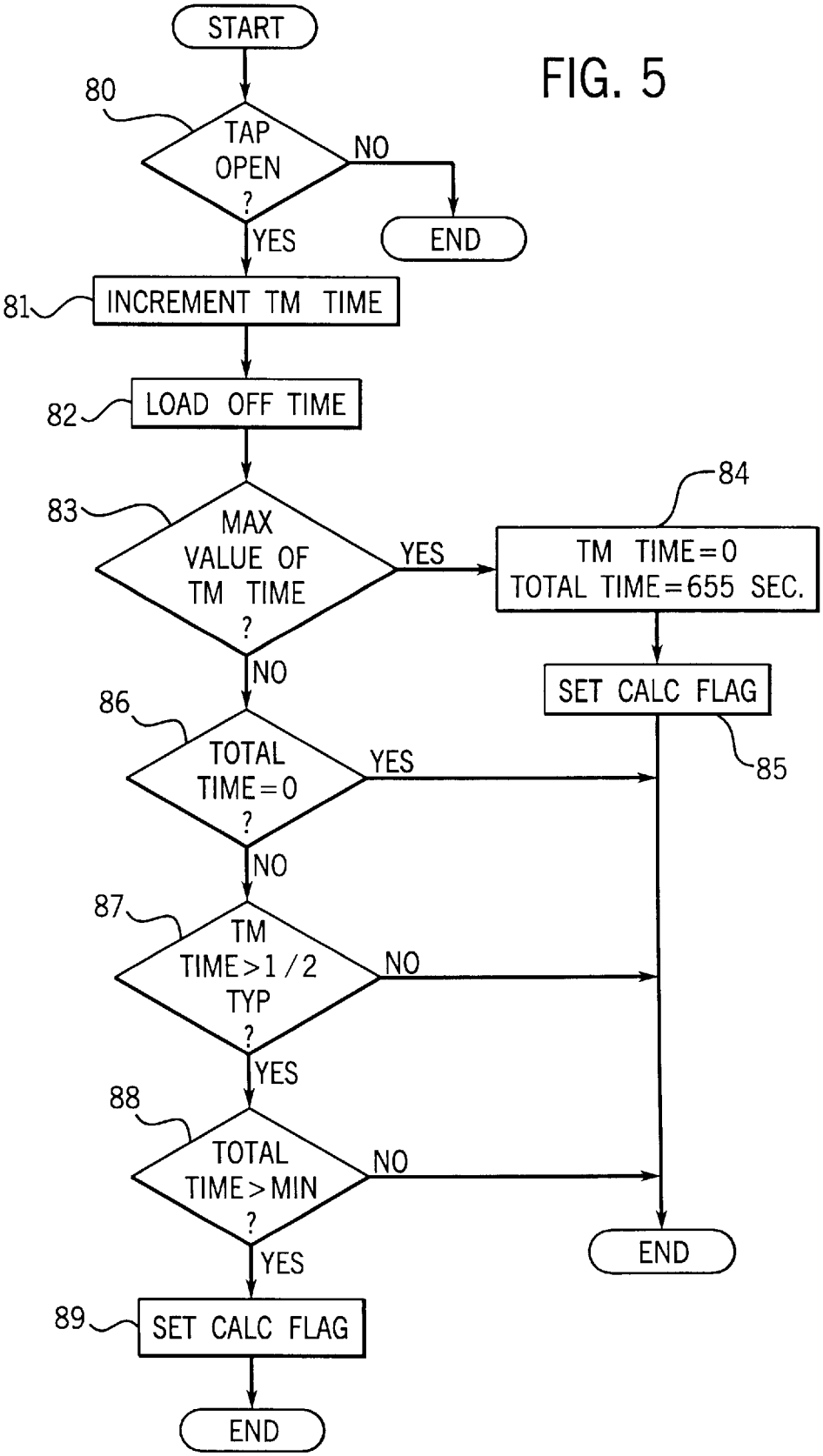
FIG. 5 is a flowchart of an interrupt routine which is executed by a microcomputer in the system monitor whenever the tap is open.

With initial reference to FIG. 1, a dispenser 10 for beverages, such as beer and carbonated soda, has a manual tap 12 with a fitting 15 that is adapted to couple to a supply line through which beverage is conducted under pressure from a source, such as a keg. The tap 12 has a spout 14 through which the beverage is dispensed into a container when a server operates a lever 16 on top of the tap. A decorative lever jacket 17 is fastened around the exposed section of the lever 16 leaving an exposed threaded end 19 onto which a handle may be attached identifying the particular brand of beverage associated with the dispenser 10. A housing 18 extends over the tap 12 and is held in place by a threaded compression bonnet 22 that extends around the lever 16. As will be described, the housing 18 contains a mechanism that senses when the tap is open and is designed to be placed over a previously installed tap to retrofit the tap with the sensing function.

As shown in greater detail in FIG. 2, the beverage tap 12 is of conventional design having a metal body 24 with a bore 26 extending into the body 24 from the fitting 15. The bore 26 communicates with a passage 28 through the downwardly extending spout 14. Within the bore 26 is a valve stem 30 with a sealing ring 32 at one end which engages a seat 34 of the bore 26 to close the tap 12 to the flow of beverage. The end of the valve stem 30 remote from the sealing ring 32 has an annular groove 33 that is engaged by one end of the tap operating lever 16 to move the valve stem along the tap bore 26. The front end 35 of the valve stem 30 that is adjacent the annular groove 33 projects through an opening in the front of the tap body 24.

The lever 16 extends through an opening at the top of the tap body 24 and has a partially spherical section 36 that is received within a curved socket of that opening. The lever is captivated in the socket by a friction ring 38 and a washer 40 that are compressed against partially spherical section 36 by the compression bonnet 22 which is threaded onto a collar 46 of the tap 12 which projects upward through an aperture 42 in the housing 18. The housing is formed by a hollow shell that slides downward over the tap body 24 and is held in place by the compression bonnet 22. This assembly of components forming the tap 12 is of a conventional design commonly found in previous beverage dispensing systems.

The housing is fitted with a mechanism that emits an electrical signal upon operation of the tap 12. Specifically, the front portion of the housing, which extends over the front of the tap body 24, contains a switch assembly 48 that includes a printed circuit board 50 from which a four-conductor cable 52 extends to a system monitor 20 shown in FIGS. 1 and 3. A first pair of conductors 51 in the cable 52 is electrically connected together on the printed circuit board 50. That connection completes an electrical circuit which indicates to the system monitor 20 that the switch assembly 48 is connected thereto. Any attempt to disconnect the switch cable 52 from the computer will interrupt this circuit thereby providing an electrical indication to the computer that the cable is disconnected. Such disconnection may occur should a server attempt to defeat the automatic sensing of the tap operation in order to dispense drinks without depositing payment in the till.

The printed circuit board 50 has a pair of switch contacts printed thereon which are connected to a second pair 53 of conductors in cable 52. As shown in FIG. 2, a resilient, silicone rubber actuator 54 of switch assembly 48 has a flange 56 that is sandwiched between the printed circuit board 50 and a boss on the interior of the housing 18. In this orientation, the actuator 54 is pressed against the printed circuit board 50 in a sealed manner, thereby shielding the switch contacts from liquids, such as the beverage or cleaning solutions.

The central portion of the actuator 54 is normally biased away from the printed circuit board by the resiliency of the material of which the actuator is made. When the tap 12 is in the closed state the end of the valve stem 30 pushes the central portion of the actuator 54 against the printed circuit board switch contacts. The surface of this central portion has an electrically conductive coating, thereby providing a conductive path between the switch contacts and sending an electric current through the second pair of conductors in cable 52. When the tap is open, the valve stem 30 no longer pushes actuator 54 against the printed circuit board, thereby allowing the resiliency of the actuator to return to a normally biased position away from the switch contacts, terminating the electric current. Therefore, an electric current flowing or not flowing through the second pair of conductors indicates to the system monitor 20 that the tap is closed or open, respectively.

With reference to FIG. 3, the system monitor 20 comprises a microcomputer 60 which has an internal read-only memory 62 and an internal random access memory 64. Additional external memory devices may be provided to increase the storage capacity of the system monitor. The read-only memory (ROM) 62 stores the control program which is executed by a microprocessor within the microcomputer 60. The random access memory (RAM) 64 provides storage for data used and generated by the microcomputer in the course of executing the control programs. RAM 64 has battery back-up to retain the data in the event of a power failure.

The microcomputer 60 has inputs that are connected to the conductors of cable 52 from the beverage dispenser 10. Although not shown in FIG. 3, a microcomputer 60 may have additional inputs for similar cables from other beverage dispensers, thereby enabling a single system monitor 20 to supervise a plurality of beverage dispensers. However, in order to simplify the description of the present invention, the function of the system monitor 20 with respect to only a single beverage dispenser 10 will be described. The system monitor 20 also has a serial communication interface 66 which is connected to an input/output port of the microcomputer 60 thereby enabling the microcomputer to send and receive data via a communication link 68. As will be described, a personal computer may be connected to the serial communication link 68 in order to initially program the microcomputer with default values for the variables used in the monitoring operation and to receive the data that results from monitoring the beverage dispenser 10.

As will be described in greater detail, the system monitor 20 responds to the operation of the beverage tap 12 by measuring the time that the tap remains open. From the amount of time that the beverage tap remains open, the system monitor 20 determines how many containers of beverage have been poured and the total volume of beverage that has been dispensed through the tap 12. This monitoring operation assumes that all of the beverage containers are of the same size (e.g. ten ounces).

It is important to recognize that when filling a given container with beverage, a server may initially leave the tap open for a relatively long period of time until the beverage reaches the top of the container. Then, because a head of foam may form on the beverage within the container, the operator may close the tap for a brief interval allowing the foam to collapse before reopening the tap to "top-off" the container. Furthermore, when serving beer, it is desirable that the container have a head of foam which enhances the appearance of the beverage serving. To create the head of foam, the beverage server may rapidly open and close the tap repeatedly near the end of the filling operation, thereby creating turbulence within the container causing the beverage to foam. As a consequence, a given container of beverage may be filled by a pouring operation that comprises several openings and closings of the beverage tap. Thus the system monitor 20 must be able to distinguish the tap opening and closing sequence for a single serving from a sequence in which the tap is reopened shortly after filling one container to fill another container. In addition, when the server is pouring several containers for a given customer, the tap may be left in the open position to continuously pour the beverage while each container is sequentially placed under the spout. A feature of the present system monitor 20 is the ability to interpret the tap opening/closing sequences to determine the number of containers which are being filled by a server. When the tap has not been in operation for a relatively long period of time, the beer that remains in the tap and the supply line immediately adjacent thereto will be relatively warm. Serving personnel recognize this and may open the tap briefly to flush the warm beverage into the drain. The present system monitor 20 also is able to distinguish these relatively short flushing operations.

In order to reach such determinations, the system monitor 20 is configured upon installation with default data about the pouring operation. During configuration, a personal computer (not shown) is connected to the serial communication interface 66 and the default data is downloaded into the system monitor. This data is stored within a series of data tables, shown in FIG. 4, that are retained within the RAM 64 of the microcomputer 60. The data table 70 has a first section 72 which contains system configuration variables. This data includes the volume of the beverage container into which the beverage is to be dispensed. As noted previously all of the beverage containers are of same size.

The time required to fill a beverage container usually varies with changes in the pressure of the beverage supply and the manner in which different servers begin and end a pour. As a result, the container filling time used by the system to classify the pouring is stated as a time range. This range is defined as plus and minus a certain percentage of a nominal pour time for a given beverage tap 12. The low percentage and high percentage are stored within the system configuration section 72 and the same set of percentages are used for all the taps being supervised by the system monitor 20. An off idle time also is stored in this data table section 72 to specify the minimum period of time which the beverage tap must remain closed in order for the system monitor 20 to conclude that a pouring operation has terminated. For example, the off idle time may be eight seconds. In this case, if no further pouring activity occurs for eight second, the pour is considered to be completed.

The data table 70 also includes sections 74, 76 and 78 which store values that are unique to each individual tap being monitored. The section 74 for the first tap 12 is expanded within FIG. 4 to show storage locations for each item of data. Because the beverage pressure and valve passage size may vary from tap-to-tap, the individual tap data includes the TYPICAL POUR TIME (TYP) required to fill the beverage container. From this TYPICAL POUR TIME and the low and high percent specified in section 72 of the data table, a minimum pour time (MIN) and a maximum pour time (MAX) are determined. For example, if the TYPICAL POUR TIME (TYP) is 5 seconds and the low percent and the high are both 20%, the minimum pour time (MIN) will be 4 seconds and the maximum pour time (MAX) will be 6 seconds. Another storage location is provided to hold a value corresponding to the FLOW RATE of beverage from the spout. As will be described, this value is calculated from the TYPICAL POUR TIME and the beverage container volume.

Storage locations are provided for timers used to monitor the operation of the tap 12. A first timer measures the period, designated TM TIME, of each opening of the tap 12. When the tap is then closed even momentarily, this open time TM TIME is summed into a TOTAL TIME storage location and the TM TIME storage location is set to zero. Another timer location designated OFF TIME contains a measurement of a period that the tap is continuously in the closed state. The next storage location in data table section 74 contains two flags, the purpose for which will be described subsequently.

The remainder of the data table section 74 for tap 12 comprises five pairs of locations for storing a count and an accumulated poured volume for five pour classifications. The first classification is a "short pour" which occurs when the tap is open for an aggregate time that is less than the minimum pour time (MIN) designated for the beverage container (pouring time<MIN). The second classification is a "valid pour" which is used to tabulate pours that are considered valid for the specified container size and pouring time range. A single valid pour occurs when the tap is open during a serving operation for an aggregate period of time that falls between the minimum pour time and the maximum pour time (MIN<pouring time<MAX). A third pour classification is an "over pour" which tabulates the amount of time by which a pour operation exceeds the maximum pour time for the beverage container, but is less than twice the TYPICAL POUR TIME (MAX<pouring time<2*TYP). For example, if the maximum pour time is six seconds and the tap is opened during a pouring operation for seven seconds, an over pour of one second occurs, in addition to counting one valid pour. The fourth classification is a "continuous pour" which occurs when the tap is left open for longer than two typical pour operations (pouring time>2*TYP). The fifth category tabulates the over pour time which occurs during a continuous pouring operation which designates the amount of time remaining after dividing the continuous pour time by the TYPICAL POUR TIME for one beverage container.

Referring to FIG. 5, the microcomputer 60 executes an open tap interrupt routine every ten milliseconds. When the tap is in the open state, the open tap interrupt routine increments the contents of the TM TIME data table location upon each execution thereby measuring the period of time between each opening and closure of the tap. As will be described when the tap closes, the current value of TM TIME is added to the TOTAL TIME and the TM TIME is set to zero. The open tap interrupt routine commences at step 80 by testing the input to the microcomputer from the tap switch 48 and determining whether the tap is open. If the tap is closed, execution of the interrupt routine terminates. However, if the tap is found to be open, the program execution advances to step 81 where the value TM TIME of the tap open timer stored in the data table for tap 12 is incremented. Next, the OFF TIME location within the data table is loaded with the value of OFF IDLE TIME at step 82 thus resetting the tap closed timer. A determination then is made at step 83 whether the value of TM TIME has reached the maximum value (e.g. about 655 seconds) capable of being stored in the data table. If that is the case, the program execution branches to step 84 where TM TIME is set to zero and the TOTAL TIME is set to 655 seconds. Then at step 85, the CALC FLAG is set to force calculation of the pour time, as the open tap timer has reached the maximum value. Execution of the open tap interrupt routine then terminates.

However, if at step 83 TM TIME is not at the maximum value, the open tap interrupt routine advances to step 85. At this juncture the contents of the memory location designated "TOTAL TIME" is checked for a zero value which if the case causes the open tap interrupt routine to terminate as it is not time to make a pour classification. When the TOTAL TIME is non-zero, the interrupt routine continues to step 85 at which a determination is made whether the value of TM TIME is greater than one-half the TYPICAL POUR TIME (TYP). If that determination is false, the open tap interrupt routine terminates. Otherwise, the program execution advances to step 88 where the microcomputer 60 determines whether the TOTAL TIME is greater than the minimum pour time (MIN). If that determination is true, the microcomputer sets the CALC FLAG at step 89 before terminating execution of the open tap interrupt routine.

When the tap closes, the execution of the open tap interrupt routine terminates immediately at step 80 without incrementing the TM TIME or determining whether a sufficient time has elapsed from which to determine the classification of the pour which has occurred.

Figure 6:
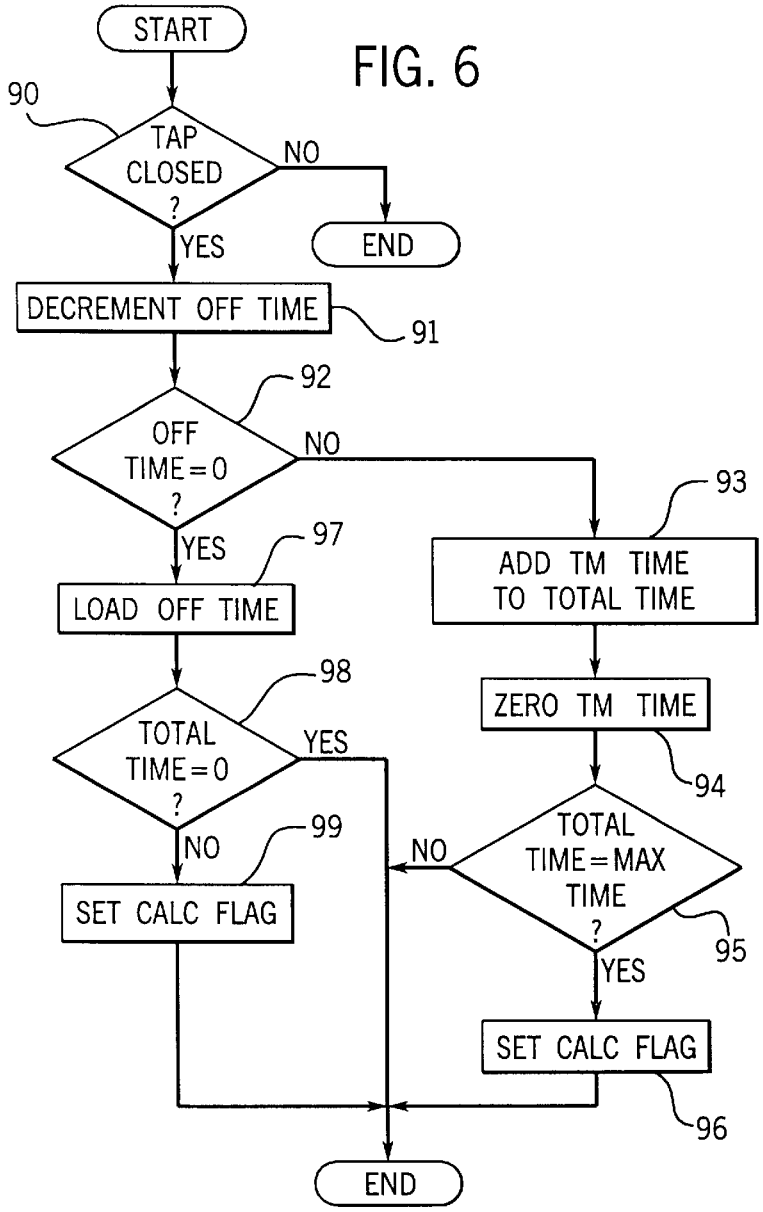
FIG. 6 is a flowchart of an interrupt routine which is executed by the microcomputer whenever the tap is closed.

While the tap 12 is in the closed state, the closed tap interrupt routine in FIG. 6 increments the contents of the OFF TIME data table location upon each execution thereby measuring the period of time until the tap 12 is opened again. This interrupt routine is executed on a timed interrupt basis every 100 milliseconds and commences at step 90 by checking the signal from the tap switch 48 to determine whether the tap is closed. If the tap is open, the execution of the interrupt routine immediately terminates. Otherwise, the execution advances to step 91 where the value of OFF TIME is decremented by an amount corresponding to 100 milliseconds. The OFF TIME was previously loaded (at step 82 of the open tap interrupt routine) with the OFF IDLE TIME and now is decremented while the tap 12 remains closed. At step 92, the OFF TIME is inspected to determine whether it has reached zero which occurs when the tap has been closed continuously for at least the OFF IDLE TIME. If the OFF IDLE TIME has not elapsed, the program advances to step 93 where the microcomputer 60 adds the current value of the TM TIME to the contents of the TOTAL TIME storage location within the data table 70. Next at step 94, the microcomputer sets the TM TIME to zero. A determination is made at step 95 whether the TOTAL TIME equals the maximum value which can be stored within the data table location. If that is the case, the CALC FLAG is set at step 96 to force a determination of the pour classification before the closed tap interrupt routine terminates.

If the OFF TIME was found to equal zero at step 92, the program execution advances to step 97 where the OFF TIME is reloaded with the value from the OFF IDLE TIME storage location within section 72 of the data table. Next, at step 98 a determination is made whether the value of TOTAL TIME is equal to zero which occurs when the tap has remained closed for a significant period of time. In this case the program execution simply terminates. Otherwise when the TOTAL TIME has a non-zero value, the microcomputer 60 sets the CALC FLAG at step 99 before terminating execution of the close tap interrupt routine.

If in the course of dispensing beverage into a single container the server opens and closes the tap several times, such as to put a head of foam on the container, the open tap and close tap interrupt routines will be actively executed several times. At the end of the procedure, the TOTAL TIME storage location within the memory data table 70 will have a value equal to the accumulated time that the tap was in the open state and the CALC FLAG will have been set.

Figure 7A:
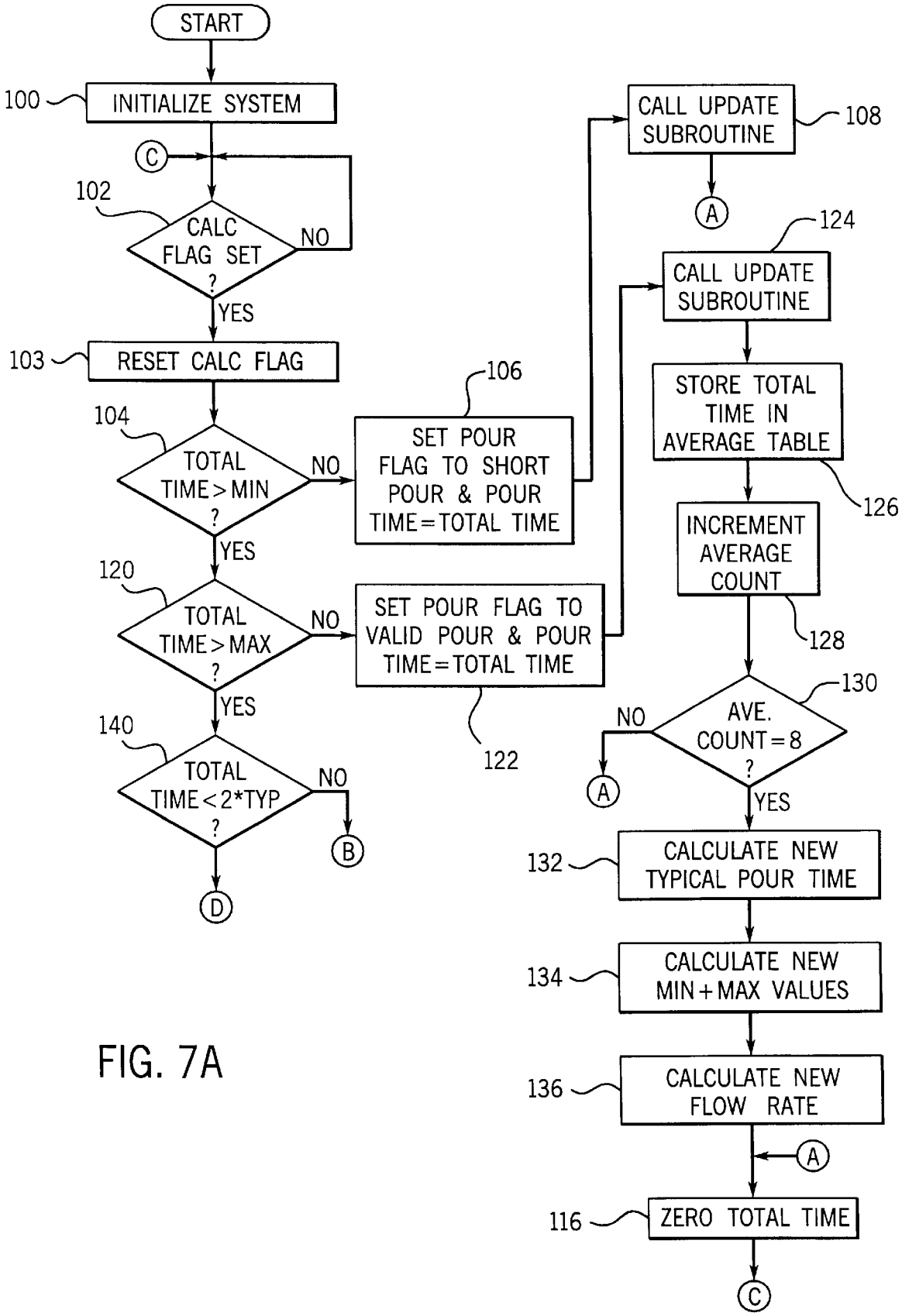
FIGS. 7A, 7B and 7C form a flowchart of a main program that is executed by the microcomputer to determine different types of beverage dispensing operations.

The main program for monitoring the beverage taps and characterizing the type of pouring is depicted in the flowchart which begins on FIG. 7A. Execution of this program commences at step 100 where the system is initialized. For example, the microcomputer 60 upon power-up resets the CALC and POUR FLAGS within the data section 74, for the beverage tap 12. Then at step 102 the CALC FLAG is inspected. If that flag has not been set by the execution of one of the two interrupt routines previously described, the program execution continues to loop through step 102. Eventually the CALC FLAG will be found to have been set and the program execution advances to step 103 the CALC FLAG is reset.

Then the main program makes a determination of the classification of the pour which caused the CALC FLAG to be set. At the first step 104 of this process, the value of TOTAL TIME is inspected to determine if it is greater than the minimum pour time (MIN) . If that is not the case, a short pour, which is an amount that is less than required to fill the beverage container, has been dispensed. In response, the microcomputer 60 sets the POUR FLAG within the data table section 74 to a value which indicates a short pour. At the same step the value of TOTAL TIME is transferred into another variable designated POUR TIME. Then the main control program calls an "update subroutine".

Figure 8:
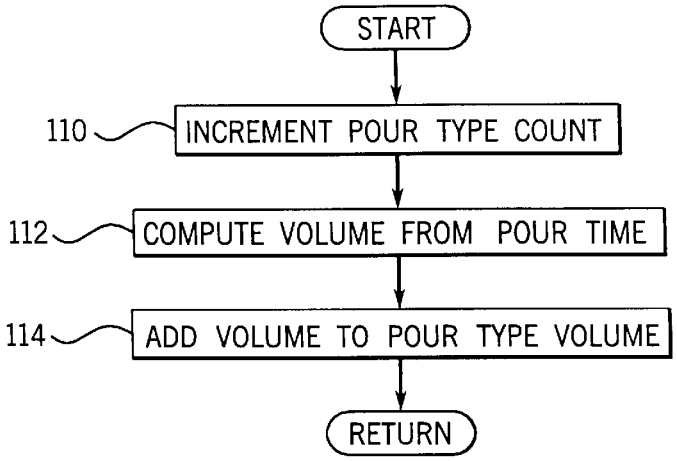
FIG. 8 is a flowchart of a subroutine which is called by the main program.

The update subroutine is depicted by the flowchart in FIG. 8 and is executed at several different branches of the main control program to update the contents of the storage locations for respective ones of the five pour classifications within the section 74 of the data table 70 that corresponds to tap 12. Which ones of the storage locations get updated each time the subroutine is executed is determined by the value of the POUR FLAG. For example, when the update subroutine is called at step 108, the data locations for the SHORT POUR COUNT and SHORT POUR VOLUME will be updated due to the value of the POUR FLAG. Specifically, the update subroutine commences at step 110 by incrementing the pour type count, in this case the SHORT POUR COUNT. Then, at step 112, the volume of beverage which has just been dispensed is computed by multiplying the current value of POUR TIME by the FLOW RATE for tap 12. Then at step 114 the microcomputer 60 adds the newly computed volume to the pour type volume, which in this case is the SHORT POUR VOLUME and the sum is then stored in the appropriate location of data table 70. The update subroutine then returns to the point from which it was called in the main control program, in this instance step 108 on FIG. 7A.

Upon returning, the program execution jumps to step 116 at which the value of TOTAL TIME is set to zero before the program execution returns to step 102 to await another setting of the CALC FLAG.

If at step 104, the microcomputer 60 finds that the TOTAL TIME is greater than the minimum pour time (MIN), the program execution advances to step 120 at which a determination is made whether the value of TOTAL TIME is greater than the maximum pour time (MAX). When that is not the case, the system monitor 20 concludes that a single beverage container has been filled and the POUR FLAG is set to indicate a valid pour at step 122. The variable of POUR TIME also is set equal to the value of TOTAL TIME. The program execution then advances to step 124 where the update subroutine is called to increment the VALID POUR COUNT and update the VALID POUR VOLUME in a similar manner to that described previously with respect to the short pour variables.

When the update subroutine returns, execution of the main program enters a section beginning at step 126 which averages the current pour times. When the beverage is supplied from a keg or canister that is pressurized with compressed gas, the flow rate and thus the beverage pour time varies with fluctuations in the gas pressure. As compensation, the main program recomputes the TYPICAL POUR TIME (TYP) following each unique group of eight valid pours. The new TYPICAL POUR TIME then is used to derive new minimum and maximum pour times (MIN and MAX) and a new FLOW RATE.

The first step 126 in this program branch enables the microcomputer 60 to store the current TOTAL TIME in an average table which has eight storage locations for such dispensing times. Next, a count of the values in this table, designated AVERAGE COUNT, is incremented at step 128. The microcomputer 60 at step 130 determines whether AVERAGE COUNT equals eight which indicates that the average table is full and it is time to calculate a new TYPICAL POUR TIME (TYP). If the average count has not reached this level, the program execution jumps to step 116 to reset the main control program for another dispensing operation.

When eight dispensing times have been stored in the average table, the microcomputer 60 advances to step 132 at which the average value of the eight valid pour times in the table is computed and stored in the data table 70 as the new TYPICAL POUR TIME (TYP) for tap 12. Then at step 134, the new TYPICAL POUR TIME (TYP) is multiplied by the LOW PERCENT and HIGH PERCENT values from section 72 of the data table to produce new minimum and maximum pour times (MIN and MAX) for tap 12 which then are stored in the appropriate locations within section 74 of the data table 70. The new TYPICAL POUR TIME next is divided into the BEVERAGE CONTAINER VOLUME read from section 72 of the data table to produce a new value for the FLOW RATE for tap 12 which then is stored in data table section 74. The execution of the main program branch for a valid pour then advances to step 116 where the value for the TOTAL TIME is set to zero and before looping back to step 102 near the beginning of the main program.

If at step 120 the inspection of the TOTAL TIME indicates that it is greater than the maximum pour time (MAX), the system monitor 20 concludes that the previous pour operation was longer than that which normally occurs when dispensing beverage into a single container. Thus, at step 140, the microcomputer 60 determines whether the TOTAL TIME is less than twice the TYPICAL POUR TIME (TYP). If the answer to this query is "yes", the system monitor concludes that a single valid pour occurred with an over pour of additional beverage.

Figures 7B, 7C:
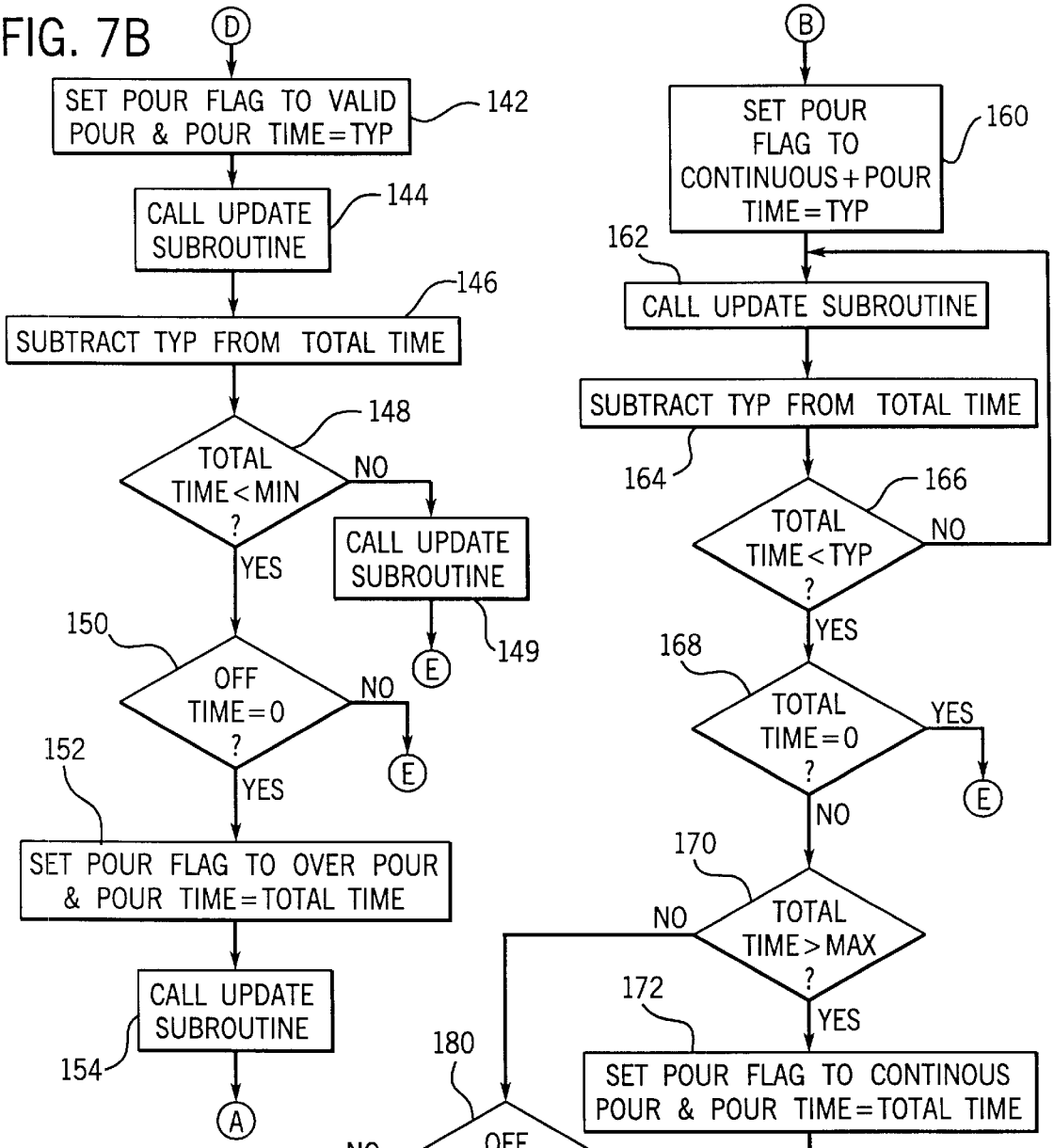

In response, the program advances to step 142 on FIG. 7B at which the POUR FLAG is set to indicate a valid pour and the variable POUR TIME is set to equal the TYPICAL POUR TIME (TYP) so that the update subroutine will increase the VALID POUR VOLUME by the quantity in one serving container. The update subroutine is called at step 144, which updates the VALID POUR COUNT and VALID POUR VOLUME. Thereafter at step 146, the TYPICAL POUR TIME (TYP) for a single container of beverage is subtracted from the TOTAL TIME. At step 148 the microcomputer 60 determines whether the remaining value of TOTAL TIME is less than the minimum pour time (MIN) in which case the remainder in TOTAL TIME represents an over pour amount. If TOTAL TIME is greater than that value, the program execution branches to step 149 where the values for a valid pour are changed again by the update routine to indicate that beverage was dispensed into two containers during the last pouring operation. Note that the pour flag was set to a valid pour at previous step 142. Then, the program jumps to step 116 to clear the TOTAL TIME.

When the value of TOTAL TIME found at step 148 is less than the minimum pour time and the program execution advances to step 150. At this point, the microcomputer 60 determines whether the OFF TIME equals zero as occurs when tap 12 has been closed for at least the OFF IDLE TIME period designated in section 72 of the data table 70. This timeout occurs when the tap 12 is closed at the completion of a pouring operation. If the OFF TIME has timed out, the program execution branches to step 152 where the POUR FLAG is set to a value indicative of the over pour characteristic and the POUR TIME is set equal to the remainder of TOTAL TIME. The update routine then is called at step 154 so that the remainder of the TOTAL TIME will be added to the OVER POUR VOLUME and the OVER POUR COUNT is incremented. Thereafter the program execution advances to step 116 where TOTAL TIME is cleared (set to zero) before returning to step 102. However, if at step 150 the OFF TIME was found not to equal zero as occurs when pouring still is going on, the program execution jumps to step 102 without clearing the TOTAL TIME. Thus any remainder in TOTAL TIME will be applied to the ongoing pour operation.

Returning to step 140, if at this juncture microcomputer 60 finds the value of TOTAL TIME to be greater than two times the typical pour time (TYP), the system monitor 20 concludes that a continuous pour has taken place and the program execution branches to step 160 on FIG. 7C. At this point, the POUR FLAG is set to indicate the continuous pour characteristic and the POUR TIME is set equal to TYP. Then at step 162, the update subroutine is called which increments the CONTINUOUS POUR COUNT in data table section 74 and adds a quantity to the CONTINUOUS POUR VOLUME which is equal to the typical pour time (TYP) times the FLOW RATE contained in section 74 of the data table 70. Then at step 164, the microcomputer 60 subtracts the typical pour time (TYP) from the TOTAL TIME and stores the result as a new value for TOTAL TIME. The microcomputer 60 then examines the new value for TOTAL TIME at step 166 to determine if it is less than the typical pour time (TYP). If it is not, the monitoring system 20 concludes that another full container of beverage has been dispensed and the program execution returns to step 162 where the update subroutine once again increments the CONTINUOUS POUR COUNT and adds a typical serving quantity to the CONTINUOUS POUR VOLUME. The program continues to loop through steps 162 through 166 until the TOTAL TIME has a value that is less than the typical pour time (TYP).

Thereafter the program execution advances to step 168 where a determination is made whether the TOTAL TIME equals zero, in which the program execution immediately jumps to step 102 to await another setting of the CALC FLAG. However, if the value of TOTAL TIME is not equal to zero, the main program advances to step 170 at which the value of TOTAL TIME is inspected to determine if it is greater than the minimum pour time (MIN). If that condition is found to be satisfied, the program execution branches to step 172 where the POUR FLAG is set to the continuous pour indication and the POUR TIME is set equal to the TOTAL TIME. The update subroutine then is called at step 174 to increment the CONTINUOUS POUR COUNT and add a typical serving quantity to the CONTINUOUS POUR VOLUME before the TOTAL TIME is cleared at step 176 and program execution returns to step 102.

If at step 170, the microcomputer 60 finds that the value of TOTAL TIME is not greater than the minimum pour time (MIN) the program execution branches to step 180 at which the value of OFF TIME, which is a measurement of the period that the tap is closed, is inspected to see if it is zero. If that is not the case as occurs when a pour operation is still going on, the program execution returns to step 102. Any value remaining in the TOTAL TIME storage location will be applied to the characterization of the ongoing pouring operation. If however the OFF TIME has elapsed at step 180, the program advances to step 182 at which the POUR FLAG is set to the OVER/CONTINUOUS POUR indication and the POUR TIME is set equal to the TOTAL TIME. Then at step 184, the update subroutine is called to update the variables for the OVER/CONTINUOUS POUR to reflect dispensing of another typical beverage container. Next at step 186, the TOTAL TIME is cleared and the program execution jumps to step 102 to await another setting of the CALC FLAG.

Thus, each time the CALC FLAG is set, the main program depicted on FIGS. 7A, 7B and 7C is executed to account for the quantity of beverage which was just dispensed. At any given point in time the storage locations within section 74 of the data table 70 which store data for tap 12 will contain information regarding the beverage dispensing from that tap. The combined counts of VALID POUR COUNT and CONTINUOUS POUR COUNT represent the number of containers filled at the tap 12. The corresponding SHORT POUR COUNT indicates the number of times the valve was used to dispense less than a full container. The OVER POUR COUNT indicates how often a single container was dispensed with more beverage flowing from tap 12 than normally is required to fill one container. The OVER/CONTINUOUS POUR COUNT indicates the number of times that a continuous pour operation occurred in which more beverage was dispensed than the quantity required to fill an exact number of containers. The corresponding storage locations for the various types of beverage volumes indicate the quantities of beverage dispensed during each type of operation and the sum of these volumes indicates the total quantity of beverage dispensed since the last time the storage locations were reset.

That information may be read by supervisory personnel by means of a personal computer (not shown) connected to the communication interface 66 (FIG. 3) of the system monitor 20. The personal computer may also contain a program which adds all of the individual pour characteristic volumes together to obtain an aggregate volume and also perform a statistical analysis on the numerical data. Once the supervisory personnel have read the variables relating to the different pour characteristics from the memory of the microcomputer 60, a command may be sent from the personal computer to the system monitor 20 which clears the contents of the storage locations preparing the monitor for another accounting period. For example, the system monitor memory locations may be cleared daily or at the end of each work shift, depending upon the desired accounting period.

The present system monitor 20 provides a unique way in which to determine the number of serving containers filled at a given tap and the total quantity of beverage which has been dispensed through the use of a simple switch coupled to sense when the tap is opened and closed. Unlike prior use of such simple sensors which merely counted the opening and closing operations, the present invention is able to derive from the same sensing information more complex data regarding the number of containers filled and other classification of how the beverage was dispensed.

We claim:

1. A method for monitoring operation of a beverage tap which has a valve that controls flow of a beverage into a serving container and which has a device that provides an electrical signal indicative of whether the beverage tap is open or closed, the method comprising the steps of:

receiving the electrical signal;

utilizing the electrical signal to measure how long the beverage tap is open to produce a tap open time measurement;

determining from the tap open time measurement a quantity of serving containers have been filled with the beverage by dividing the tap open time measurement by a typical pour time to produce a quotient which indicates how many serving containers have been filled with the beverage; and in response to the determining step, storing in memory a count of how many serving containers have been filled with the beverage.

2. The method as recited in claim 1 wherein the determining step determines whether the tap open time measurement falls within a range of values indicative of dispensing the beverage into a single serving container.

3. The method as recited in claim 1 wherein the determining step concludes that one serving container has been filled with beverage when the tap open time measurement falls within a range of values.

4. The method as recited in claim 1 further comprising determining from the tap open time measurement a quantity of the beverage which has been dispersed from the beverage tap.

5. The method as recited in claim 1 further comprising utilizing the electrical signal to measure how long the beverage tap is closed to produce a tap closed time measurement; and wherein the determining step is performed in response to the tap closed time measurement.

6. A method for monitoring operation of a beverage tap which has a valve that controls flow of a beverage into a serving container and which has a device that provides an electrical signal indicative of whether the beverage tap is open or closed, the method comprising the steps of:

receiving the electrical signal;

utilizing the electrical signal to measure how long the beverage tap is open to produce a tap open time measurement; and determining from the tap open time measurement a quantity of beverage that has been dispensed from the beverage tap by multiplying the tap open time measurement by a beverage flow rate to determine the quantity of beverage.

7. A method for monitoring operation of a beverage tap which has a valve that controls flow of a beverage into a serving container and which has a device that provides an electrical signal indicative of whether the beverage tap is open or closed, the method comprising:

measuring, in response to the electrical signal, how long the beverage tap is open to produce a tap open time;

determining whether the tap open time is within a range of values indicative of dispensing the beverage into a single serving container;

in response to the determining step, incrementing a serving container count;

detecting whether the tap open time is greater than a predefined value to provide a determination that the beverage tap has been open for longer than a time required to fill a single beverage container;

in response to the detecting step, producing an estimate of how many serving containers were filled while the beverage tap was open; and adding the estimate to the serving container count.

8. The method as recited in claim 7 wherein the step of producing a numerical estimate divides the tap open time measurement by a typical pour time to produce a quotient which indicates how many serving containers were filled.

9. The method as recited in claim 7 further comprising determining from the tap open time measurement a quantity of the beverage which has been dispensed from the beverage tap.

10. The method as recited in claim 7 further comprising multiplying the tap open time measurement by a beverage flow rate to determine a quantity of the beverage which has been dispensed from the beverage tap.

11. A method for monitoring operation of a beverage tap which has a valve that controls flow of a beverage into a serving container and which has a device that provides an electrical signal indicative of whether the beverage tap is open or closed, the method comprising steps of:

measuring, in response to the electrical signal, how long the beverage tap is open to produce a tap open time;

measuring, in response to the electrical signal, how long the beverage tap is closed to produce a tap closed time; and responding to the tap closed time by characterizing a beverage pour operation, wherein the characterizing comprises:

(a) incrementing a short pour count when the tap open time is less than a first value;

(b) incrementing a valid pour count when the tap open time is greater than the first value and less than a second value; and (c) when the tap open time is greater than a third value, producing a numerical estimate of how many serving containers were filled while the beverage tap was open, and adding the numerical estimate to the valid pour count.

12. The method as recited in claim 11 further comprising when the tap open time is less than a first value, determining a short pour volume in response to the tap open time and a beverage flow rate.

13. The method as recited in claim 11 further comprising when the tap open time is less than a first value, determining an over pour volume based on a remainder produced by dividing the tap open time by a typical pour time for filling a single serving container.

14. A method for monitoring operation of a beverage tap which has a valve that controls flow of a beverage into a serving container and which has a device that provides an electrical signal indicative of whether the beverage tap is open or closed, the method comprising the steps of:

receiving the electrical signal;

utilizing the electrical signal to measure how long the beverage tap is open to produce a tap open time measurement;

determining, from the tap open time measurement and from a typical pour time to fill a single serving container, a quantity of serving containers have been filled with the beverage; and in response to the determining step, storing in memory a count of how many serving containers have been filled with the beverage;

deriving, from tap open time measurements, an actual time period required to fill a single serving container with beverage;

storing a plurality of actual time periods;

computing an average time period from the plurality of actual time periods; and adjusting the typical pour time in response to the average time period.

15. The method as recited in claim 14 further comprising utilizing the electrical signal to measure how long the beverage tap is closed to produce a tap closed time measurement; and wherein the determining step is performed in response to the tap closed time measurement.

16. A method for monitoring operation of a beverage tap which has a valve that controls flow of a beverage into a serving container and which has a device that provides an electrical signal indicative of whether the beverage tap is open or closed, the method comprising the steps of:

receiving the electrical signal;

utilizing the electrical signal to measure how long the beverage tap is open to produce a tap open time measurement;

multiplying the tap open time measurement by a beverage flow rate to determine a quantity of the beverage which has been dispensed from the beverage tap;

determining from the tap open time measurement a quantity of serving containers have been filled with the beverage; and in response to the determining step, storing in memory a count of how many serving containers have been filled with the beverage.

17. The method as recited in claim 16 further comprising deriving a new value for the beverage flow rate from a plurality of tap open time measurements and a serving container size.

* * * * *